US007639269B2

(12) United States Patent
Mizukami et al.

(10) Patent No.: US 7,639,269 B2
(45) Date of Patent: Dec. 29, 2009

(54) PRINTER AND INK SHEET

(75) Inventors: Junichi Mizukami, Iruma (JP); Atsushi Hanada, Nishitokyo (JP); Naoki Yoshida, Tokorozawa (JP); Hiroyuki Kasahara, Toshima-ku (JP)

(73) Assignee: TEAC Corporation, Tama-shi (JP)

( * ) Notice: Subject to any disclaimer, the term of this patent is extended or adjusted under 35 U.S.C. 154(b) by 0 days.

(21) Appl. No.: 12/057,198

(22) Filed: Mar. 27, 2008

(65) Prior Publication Data

US 2008/0266374 A1 Oct. 30, 2008

(30) Foreign Application Priority Data

Apr. 24, 2007 (JP) ..... 2007-114639

(51) Int. Cl.
*B41J 2/325* (2006.01)

(52) U.S. Cl. ..... 347/213; 347/217

(58) Field of Classification Search ..... 347/213, 347/217, 178; 400/237, 240, 240.3
See application file for complete search history.

(56) References Cited

U.S. PATENT DOCUMENTS 5,634,731 A 6/1997 Kita

FOREIGN PATENT DOCUMENTS

| | | | |
|---|---|---|---|
| JP | 61-152479 | A | 7/1986 |
| JP | 3465963 | B2 | 1/1996 |
| JP | 2002-337466 | A | 11/2002 |
| JP | 2005-131954 | A | 5/2005 |

*Primary Examiner*—Huan H Tran
(74) *Attorney, Agent, or Firm*—Christensen O'Connor Johnson Kindness PLLC

(57) ABSTRACT

A printer transfers to one image formation area a plurality of single colors of ink repeatedly arranged in a longitudinal direction of the ink sheet, to thus produce in an image formation area of an intermediate transfer sheet a transfer image formed as a result of lamination of single color images, and also transfers the transfer image of the intermediate transfer sheet to a subject to be printed, thereby producing a desired image on the subject. During the course of a first single color of ink C being transferred from the ink sheet to an image formation area of an intermediate transfer sheet, to thus produce a single color image in the first color on the intermediate transfer sheet, a position mark is transferred by use of a black ink area provided at a widthwise edge of an area of the first single color of ink of the ink sheet and outside the image formation area of the intermediate transfer sheet.

11 Claims, 7 Drawing Sheets

PRINTER AND INK SHEET

PRIORITY INFORMATION

This application claims priority to Japanese Patent Application No. 2007-114639 filed on Apr. 24, 2007, which is incorporated herein by reference in its entirety.

BACKGROUND

1. Technical Field

The present invention relates to a printer and an ink sheet, and more particularly to a printer that produces an image for transfer purpose (hereinafter called a "transfer image") on an intermediate transfer sheet by use of an ink sheet on which a plurality of single colors of ink are repeatedly arranged in a longitudinal direction of the sheet and that produces a desired image by means of transferring the transfer image of the intermediate transfer sheet onto a subject to be printed (hereinafter simply called a "subject") as well as to an ink sheet used for the printer.

2. Related Art

A hitherto-known printer produces a transfer image on an intermediate transfer sheet by use of an ink sheet on which a plurality of single colors of ink are repeatedly arranged in a longitudinal direction of the sheet and transfers to a subject the transfer image on the intermediate transfer sheet, thereby producing a desired image.

As shown in FIG. 8, JP 2005-131954 A discloses use of an ink sheet 20 on which four colors of ink; namely, black (BK) ink, cyan (C) ink, magenta (M) ink, and yellow (Y) ink are repeatedly arranged in such a way that different colors adjoin each other in a longitudinal direction of the sheet. Further, when an image is produced in a single color by means of transferring to an image formation area of the intermediate transfer sheet single color ink BK that is the first color of the ink sheet 20, a thermal printer head transfers the same single color BK of ink from the ink sheet 20 to the intermediate transfer sheet, thereby creating a position mark. The position mark is used for registration between an intermediate transfer sheet and a thermal printer head and registration between the intermediate transfer sheet and a subject. The position mark is formed at a side of each image formation area; namely, a position that is located between a rear of a leading end and a forward of a trailing end of each image formation area and, and outside the image formation area.

In order to perform registration of respective colors of ink while a boundary between the colors of ink is made definite, boundary marks must be provided among the single colors of ink. For instance, as shown in FIG. 9, a conceivable method is to place marks 82 among the single colors of ink and a different mark 80 at a boundary of a single color BK of ink that is the first color. The mark 80 is formed by means of notching a portion of the single color BK of ink; in other words, causing a portion of the single color BK of ink to protrude in a longitudinal direction. The mark 82 is formed from two black lines spaced apart from each other by a predetermined distance. As a result of the marks 80 and 82 being formed as mentioned above, two sensors for detecting the position of the ink sheet 20 detect reflectance along a line "a" and a line "b" in the drawing, so that the start of each single color of ink can be detected in accordance with a difference between the reflectance detected from the area "a" and the reflectance detected from the area "b." In short, in relation to the single color BK of ink, a portion of the line "a" is notched, and the line "a" exhibits high reflectance at that portion, and the line "b" exhibits low reflectance. The start of the single color BK of ink can be detected by detection of this pattern. In the meantime, in relation to the next mark 82, a black line is present along the line "a," and no black line is present along the line "b." Hence, the line "a" exhibits low reflectance, and the line "b" exhibits high reflectance. Thus, an inverse pattern appears. Accordingly, the start of the next single color C of ink can be detected by detection of the pattern. Light passes through an area where ink (a black line) is not present, and light reflected from a reflection plate is detected. In reality, a sensor of light emission type is utilized. Light does not pass through an area where there is a black ink provided along a boundary between single colors of ink, and reflected light cannot be received. In contrast, light passes through an area where there is not a black line (and a notched area), and light reflected from a reflection plate can be received, whereupon the start of each color of ink is detected.

However, when the marks 80 and 82 are formed on the ink sheet 20 as mentioned above, areas where ink is present become asymmetrical with respect to the longitudinal center axis of the sheet, and the thickness of black ink becomes accumulated. Unevenness arises in the diameter of an ink ribbon, and the sheet becomes eventually prone to wrinkling. An imperfect image (a decolored image attributable to wrinkles) may arise in the intermediate transfer sheet. Specifically, an ink ribbon requires about 2500 turns. If unevenness exists in the thickness of a sheet in a widthwise direction thereof, a difference of a take-up diameter (a diameter) that is 5000 times as large as an ordinary diameter will arise. On the assumption that the thickness of ink is 0.6 μm, unevenness of about 3 mm arises in a take-up diameter because of presence or absence of ink. If such an ink ribbon is pulled as it is, the diameter will change according to a position with respect to the widthwise direction, so that wrinkles may arise in the sheet.

In the related art, when an image is produced in a single color by means of transferring the single color BK of ink; namely, the first color of the ink sheet 20, to an image formation area of the intermediate transfer sheet, the thermal printer head transfers the same single color BK of ink from the ink sheet 20 to the intermediate transfer sheet, thereby creating a position mark. However, there arises a problem of the entire length of the ink sheet 20 becoming longer by an amount corresponding to the single color BK of ink. Namely, black can also originally be expressed by means of three colors of ink; that is, C, M, and Y. However, if the singe color BK of ink is deleted, there will arise a problem of the inability to produce a position mark.

SUMMARY

The present invention provides a printer and an ink sheet that enable prevention of an increase in the entire length of a sheet and formation of position marks and that also enable effective prevention of occurrence of wrinkles in the sheet.

The present invention is directed toward a printer that transfers to one image formation area a plurality of single colors of ink repeatedly arranged in a longitudinal direction of the ink sheet, to thus produce in an image formation area of an intermediate transfer sheet a transfer image formed as a result of lamination of single color images and that transfers the transfer image of the intermediate transfer sheet to a subject to be printed, thereby producing a desired image on the subject, the printer comprising an ink sheet feeding section for feeding the ink sheet; an intermediate transfer sheet feeding section for feeding the intermediate transfer sheet; a printer head that is disposed so as to face a feeding path of the ink sheet and a feeding path of the intermediate transfer sheet and that transfers ink of the ink sheet to the intermediate transfer sheet; and a print head control section that transfers a position mark to a location outside the image formation area of the intermediate transfer sheet by use of a black ink area provided at a specific position of an area of a first single color of ink of the ink sheet during a course of a single color image being produced in the first single color on the intermediate transfer sheet by means of transferring the first single color of ink from the ink sheet to the image formation area of the intermediate transfer sheet.

The present invention is also directed toward an ink sheet used with a printer that transfers to one image formation area a plurality of single colors of ink repeatedly arranged in a longitudinal direction of the ink sheet, to thus produce in an image formation area of an intermediate transfer sheet a transfer image formed as a result of lamination of single color images and that transfers the transfer image of the intermediate transfer sheet to a subject to be printed, thereby producing a desired image on the subject, the ink sheet comprising a black ink area arranged at a specific location of an area of a first single color of ink of the plurality of single colors of ink.

In one embodiment of the present invention, the black ink area is formed at an edge of an area of a first single color of ink of the ink sheet in a widthwise direction thereof and in numbers so as to become symmetrical with respect to a longitudinal center axis of the ink sheet.

According to the present invention, the black ink area used for producing a position mark is arranged at a specific location in the area of the first single color of ink; for example, an edge in the widthwise direction, thereby enabling production of the position mark and shortening of the entire length of the ink sheet. Further, the black ink areas are arranged symmetrical with respect to the longitudinal center axis of the ink sheet, so that a percentage of extension of the ink sheet is made uniform and that occurrence of wrinkles, or the like, can be prevented. Even when the single color BLK of ink for use in producing an image is not provided in the ink sheet, the black ink area for use in production of a position mark is arranged in an area of another single color of ink. Hence, a position mark can be produced simultaneous with transfer of a single color of ink, and a time loss induced as a result of production of the position mark does not arise.

The invention will be more clearly comprehended by reference to the embodiment provided below. However, the following embodiment is merely illustrative, and the scope of the invention is not limited to the embodiment.

BRIEF DESCRIPTION OF THE DRAWINGS

A preferred embodiment of the present invention will be described in detail by reference to the following drawings, wherein.

DETAILED DESCRIPTION

An embodiment of the present invention will be described hereunder by reference to the drawings.

Figure 1:
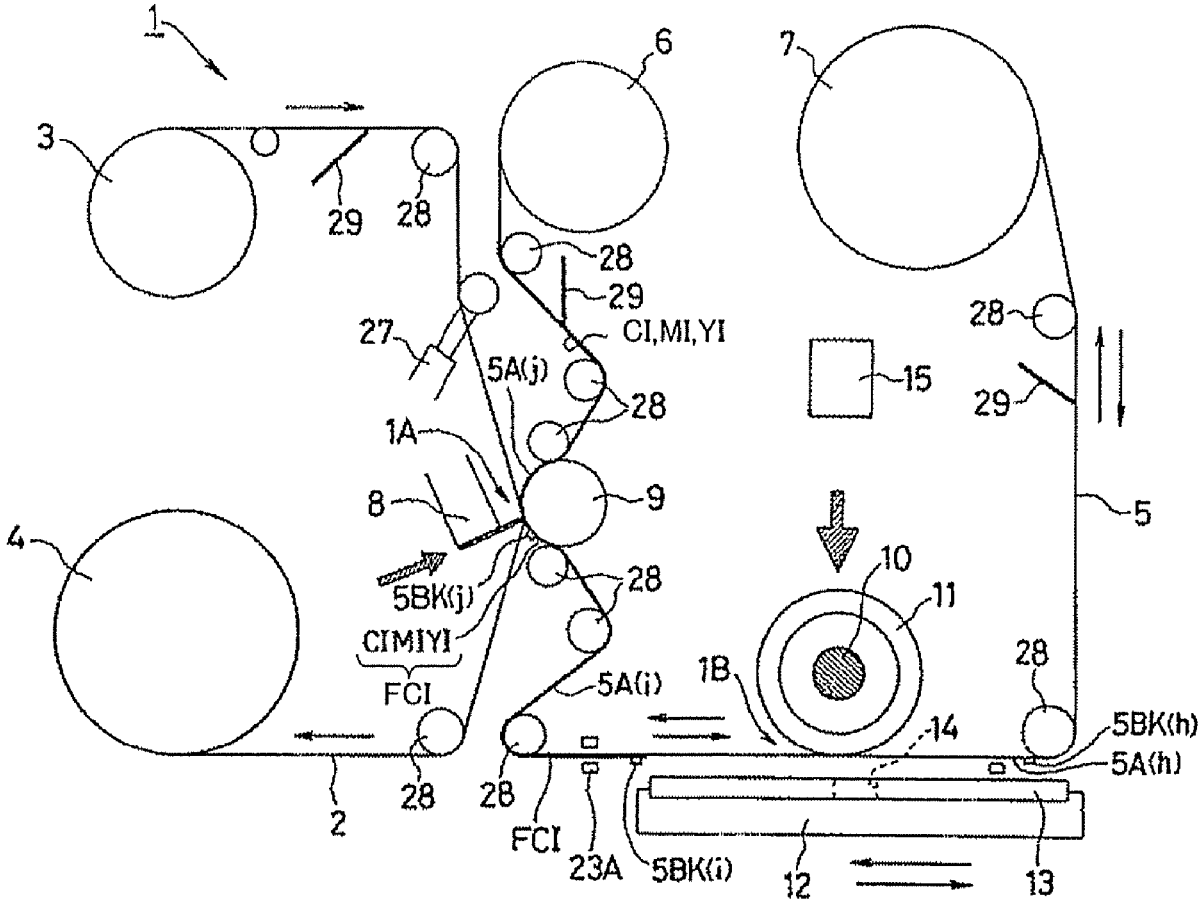
FIG. 1 is a block diagram of a printer.

FIG. 1 shows the configuration of a printer of the embodiment. In the printer of the present embodiment, an ink sheet feed roller 3 feeds an ink sheet 2 in which three single colors of ink; namely, cyan ink C, magenta ink M, and yellow ink Y, are repeatedly arranged in this sequence in such a way that different colors adjoin each other in a longitudinal direction, and the thus-fed sheet is taken up in a windable manner by an ink sheet take-up roller 4.

Moreover, an intermediate transfer sheet 5 is fed from an intermediate transfer sheet feed roller 6 and taken up in a windable manner by an intermediate transfer sheet take-up roller 7. The intermediate transfer sheet 5 can also be fed from the intermediate transfer sheet take-up roller 7 and taken up by the intermediate transfer sheet feed roller by means of reversely rotating the intermediate transfer sheet feed roller 6 and the intermediate transfer sheet take-up roller 7. The intermediate transfer sheet 5 may also be conveyed by means of conveyance force of a platen roller 9.

In a transfer image formation section 1A, a thermal printer head 8 is provided in such a way that the head can be pressed against the platen roller 9. The ink sheet 2 and the intermediate transfer sheet 5 are guided between the thermal printer head 8 and the platen roller 9 so that the sheets can be conveyed at the same speed. The three single colors of ink C, M, and Y provided on the ink sheet 2 are selectively transferred once to an image formation area 5A of the intermediate transfer sheet 5 by means of the thermal print head 8. A single color image CI produced in the single color ink C, a single color image MI produced in the single color ink M, and a single color image YI produced in the single color ink Y are repeatedly formed on a surface of the intermediate transfer sheet 5 facing the ink sheet 2. A full-color transfer image FCI are produced as a result of lamination of the three single color images CI, MI, and YI according to a swingback method.

Control means 15 is made up of a microcomputer and has a CPU and memory storing a control program. The control means 15 is connected to a driver for driving a printer head, a driver for a platen drive motor, a driver for sheet take-up motor, mark detection means 23A, a driver for a table drive motor, and a driver for a press heat transfer roller drive motor. The control means 15 drives the drivers, to thus convey the ink sheet 2 and the intermediate transfer sheet 5 at the same speed. In the middle of transfer of the sheets, the single color C of ink that is the first ink of the ink sheet 2 is transferred to the image formation area 5A of the intermediate transfer sheet 5 by means of heating of the thermal print head 8, thereby producing a single color image CI. At that time, single color of ink; that is, black ink, provided at a predetermined position on the single color C of ink is transferred to the intermediate transfer sheet 5, thereby producing position marks 5BK.

The position marks 5BK are formed at a side of each image formation area 5A; namely, a position that is located between a rear of a leading end and a forward of a trailing end of each image formation area 5A and, and outside the image formation area 5A. A full color transfer image FCI is produced by means of repeatedly producing three singe color images CI, MI, and YI in the next image formation area 5A(j) of the intermediate transfer sheet 5 with reference to the position marks 5BK formed at the time of generation of the single color image CI in the image formation area 5A(i) of the intermediate transfer sheet 5.

Specifically, the single color image CI of the first color is produced in; for example, an image formation area 5A(j), by means of bringing the thermal printer head 8 into press contact with the platen roller 9 after the mark detection means 23A has detected a position mark 5BK(i) and transferring the single color C of ink from the ink sheet 2, which is being conveyed at the same speed, to the image formation area 5A(j) of the intermediate transfer sheet 5. After completion of formation of the first single color image CI, the intermediate transfer sheet feed roller 6 and the intermediate transfer sheet take-up roller 7 are reversely rotated, thereby conveying the intermediate transfer sheet 5 in a direction opposite to the direction in which the intermediate transfer sheet is rotated at the time of formation of the singe color image CI. The intermediate transfer sheet take-up roller 7 is again forwardly rotated, to thus convey the intermediate transfer sheet 5. The single color M of ink of the ink sheet 2, which comes to the second color after the mark detection means 23A has detected the position mark 5BK(i), is transferred to the image formation area 5A(j) of the intermediate transfer sheet 5, thereby producing the single color image MI. In the followings, the single color Y of ink of the ink sheet 2, which comes to the third color, is likewise transferred to the image formation area 5A(j) of the intermediate transfer sheet 5, thereby producing a single color image YI. Thus, the full color transfer image FCI formed as a result of lamination of the single color images CI, MI, and YI is produced on the intermediate transfer sheet 5. After lamination of the full color transfer image FCI, an adhesive layer adjoining to the single color Y of the ink sheet is laid through coating.

The full color transfer image FCI formed on a single side of the intermediate transfer sheet 5 in the transfer image formation section 1A is conveyed to an image transfer section 1B by means of forward rotation of the intermediate transfer sheet take-up roller 7 and the platen roller 9. The table drive motor driver and the driver for a press heat transfer roller drive motor are driven, whereupon a press heat transfer roller 11 having a built-in electric heater 10 descends, to thus contact the intermediate transfer sheet 5 from above. As a result, the intermediate transfer sheet comes into intimate contact with an upper surface of a subject (a DVD or a CD in the embodiment) 13 placed on a movable carriage 12 situated below the intermediate transfer sheet. The intermediate transfer sheet 5 and the movable carriage 12 are conveyed in this state, whereby the full color transfer image FCI produced on the intermediate transfer sheet 5 is transferred to the subject 13 by way of the adhesive layer.

Even when the transfer image FCI is transferred from the intermediate transfer sheet to the subject 13 in the image transfer section 1B, the position marks 5BK are used for registration between the intermediate transfer sheet 5 and the subject 13. The movable carriage 12 held at rest by the table movement motor driver is moved over a predetermined distance in a rightward direction of the drawing, whereby the subject 13 is conveyed to the image transfer section 1B. The transfer image FCI of the intermediate transfer sheet 5 is conveyed to the image transfer section 1B by means of forward rotation of the intermediate transfer sheet take-up roller 7 and the platen roller 9. When the mark detection means 23A detects the position mark 5BK(j), the movable carriage 12 moves at essentially the same speed as that of the intermediate transfer sheet 5, whereby the subject 13 is conveyed. The press heat transfer roller 11 descends, to thus contact the intermediate transfer sheet 5 from above. Thereby, the intermediate transfer sheet 5 comes into intimate contact with the upper surface of the subject 13 that is being conveyed at the same speed as that of the intermediate transfer sheet 5 while being carried by the movable carriage 12. The full color transfer image FCI produced in the image formation area 5A(j) is transferred to the subject 13, whereupon an image is produced.

Figure 2:
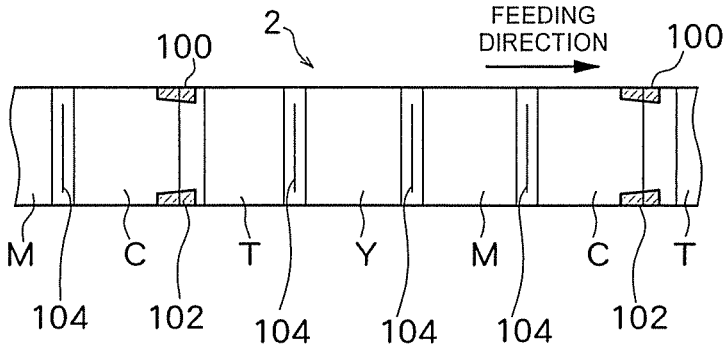
FIG. 2 is a plan view of an ink sheet.
Figure 8:
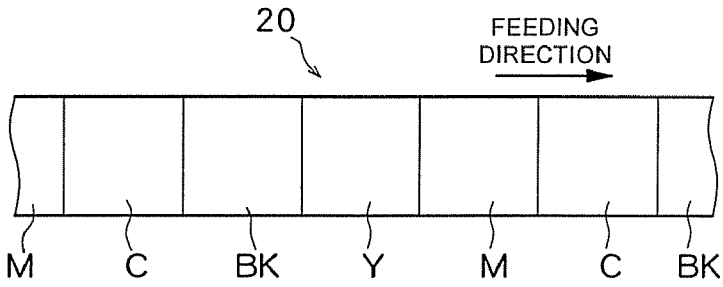
RELATED ART FIG. 8
FIG. 8 is a plan view of a related-art ink sheet.

FIG. 2 shows the configuration of the ink sheet 2 of the present embodiment. In contrast with the related-art ink sheet 20 shown in FIG. 8, the ink sheet of the present embodiment has three single colors C, M, and Y of ink that are arranged in a longitudinal direction. Further, a transparent adhesive layer T is interposed between the single color Y of ink and the single color C of ink. Since the single color BK of ink is not present as compared with the related art, the position marks 5BK using the single color BK of ink cannot be produced. In the present embodiment, black ink areas 100 and 102 are formed at predetermined locations in the area of single color C of ink in lieu of the area of related-art single color BK of ink; specifically, at widthwise ends. A black ink area 100 is formed at an upper end (a corner along an upper end) of the single color C of ink in the drawing, and a black ink area 102 is formed at a lower end (a corner along a lower end) of the single color C of ink in the drawing. The position marks 5BK are formed in either of the black ink areas 100 and 102 by use of; for example, the black ink area 102. The remaining black ink area 100 is not used for production of the position mark and is formed at a position symmetrical with respect to the black ink area 102 and in a symmetrical shape, thereby exhibiting a function for making a percentage of extension of the sheet uniform.

A black ink line 104 is formed along a boundary between the single color C of ink and the single color M of ink, a boundary between the single color M of ink and the single color Y of ink, and a boundary between the single color Y of ink and the adhesive layer T. These black ink lines 104 define boundaries among single colors of ink and are used for detecting the start (or the end) of each single color of ink. The black ink lines 104 do not extend over the entire width of the ink sheet 2 and are formed in such a way that both ends of the ink line are back from the upper and lower edges. Spaces left before the upper and lower edges are set to an essentially identical with the width of the black ink areas 100 and 102.

Figure 3:
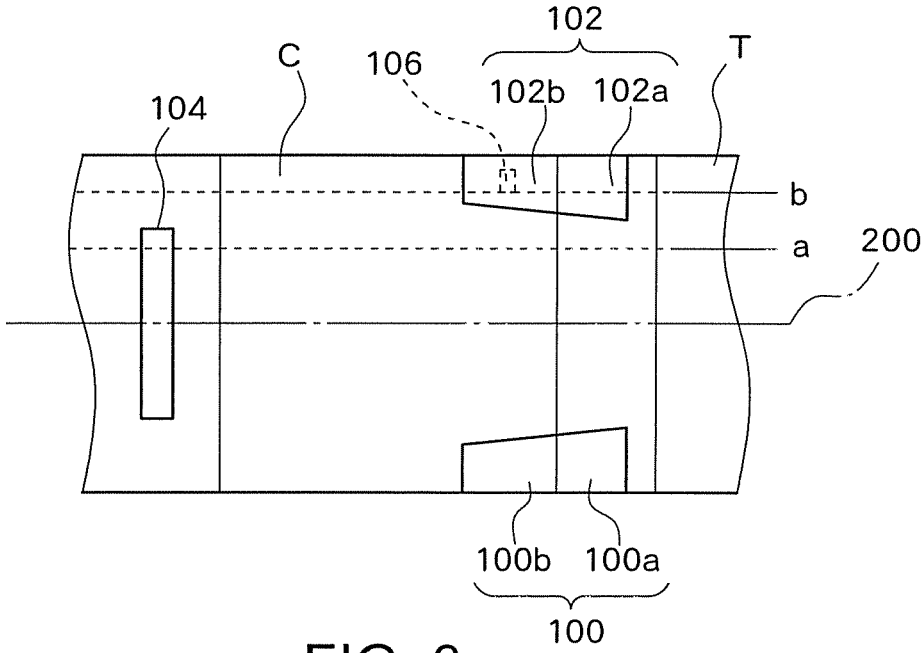
FIG. 3 is a partially-enlarged view of the ink sheet shown in FIG. 2.

FIG. 3 shows a partially-enlarged view of the ink sheet shown in FIG. 2. The black ink areas 100 and 102 are formed at ends (corners) of the area of the single color C of ink in a widthwise direction thereof. Both the black ink areas 100 and 102 are produced in black ink and into a trapezoidal shape. When attention is paid to the black ink area 102, the black ink area 102 consists of an area 102*a* that extends to the boundary between the area of the single color C of ink and the adhesive layer T in excess of the area of the single color C of ink and an area 102*b* that is present in only the area of the single color C of ink. The area 102*a* is one for detecting the start of the single color C of ink and corresponds to the mark 80 shown in FIG. 9. Specifically, the two sensors detect reflectance at the positions "a" and "b." When the reflectance detected from the position "a" is high and when the reflectance detected from the position "b" is low, the start of single color C of ink is detected. In the meantime, the area 102*b* is for producing the position marks 5BK. When the single color image CI is produced by transferring the single color C of ink from cyan color C of ink, which is the first color of the ink sheet 2, to the image formation area 5A of the intermediate transfer sheet 5, black ink is transferred from the area 102*b* to the intermediate transfer sheet 5, thereby producing the position marks 5BK. In the drawings, an ink area 106 used for producing the position marks 5BK is indicated by a broken line. The black ink area 102 can be said to be an extension of the area 102*a* used for detecting a start up to the area of the single color C of ink. Of the area of the single color C of ink, an area used for transferring single cyan color of ink to the image formation area 5A of the intermediate transfer sheet 5 is located in the vicinity of the center of the area of the single color C of ink. Hence, even the black ink areas 100 and 102 are present at ends, the black ink areas do not affect formation of the single color image CI at all.

The black ink area 100 and the black ink area 102 are formed so as to become symmetrical about a center axis 200 in the longitudinal direction of the ink sheet 2. The black ink area 100 is not an area that is required to produce the position marks 5BK but an area that is originally nonessential. However, when there is only the black ink area 102, the ink area becomes asymmetrical with respect to the center axis 200 of the ink sheet 2, which may in turn cause unevenness in take-up diameter and wrinkles in the ink sheet 2. As a result of the black ink area 100 being produced at a position symmetrical with respect to the black ink area 102 and in the same shape, the take-up diameter is made uniform, to thus prevent occurrence of wrinkles.

The black ink lines 104 are also formed symmetrical with respect to the center axis 200, thereby making the percentage of extension of the sheet uniform. The length of the black ink line 104 is shorter than the length of the width of the sheet, and spaces are left between both ends of the black ink line from the upper and lower edges of the sheet. The spaces located at both ends of and on the extension of the black ink line are formed so as to assume essentially the same width of the black ink area 102. Therefore, the start of a single color of ink can be detected. Namely, the reflectance detected by the sensor at the position "a" on the black ink line 104 is low, and the reflectance detected by the sensor at the position "b" is high (i.e., a pattern contrary to the pattern achieved in the area 102*a*), and the start of single color M of ink can be detected by detection of this pattern.

As mentioned above, as a result of the black ink areas 100 and 102 being provided along the edges of the area of the single color C of ink and the black ink line 104 being also provided, the position marks 5BK can be produced, and the start of each single color of ink (or the adhesive layer T) can be detected. In addition, the black ink areas are arranged so as to become symmetrical with respect to the center axis 200, thereby preventing occurrence of wrinkles in the sheet.

Figure 4:
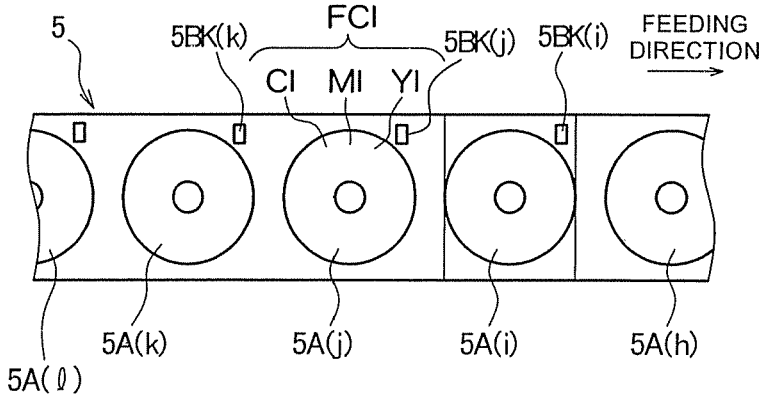
FIG. 4 is a plan view of an intermediate transfer sheet.

FIG. 4 shows the structure of the intermediate transfer sheet 5. There is produced the full color transfer image FCI in which the single color images CI, MI, and YI (and the adhesive layer T) are sequentially stacked on the image formation areas 5A(h), 5A(i), 5A(j), and 5A(k). Further, position marks 5BK(i), 5BK(j), and 5BK(k) are generated at predetermined positions with reference to the transfer image FCI; namely, at side positions. These position marks are produced by use of the black ink area 102 of single color C of ink as mentioned above.

Figure 5:
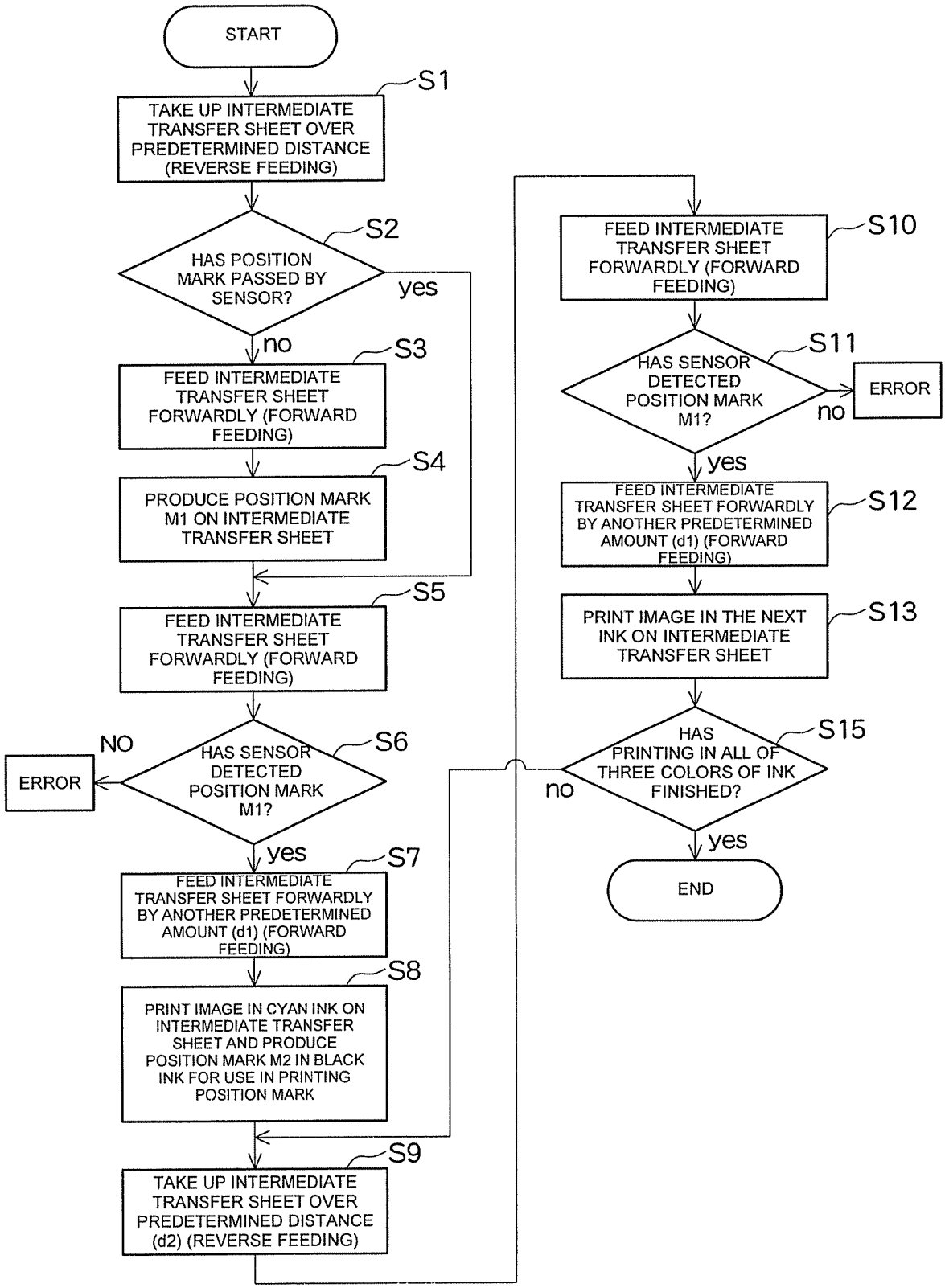
FIG. 5 is a processing flowchart.
Figure 6A:
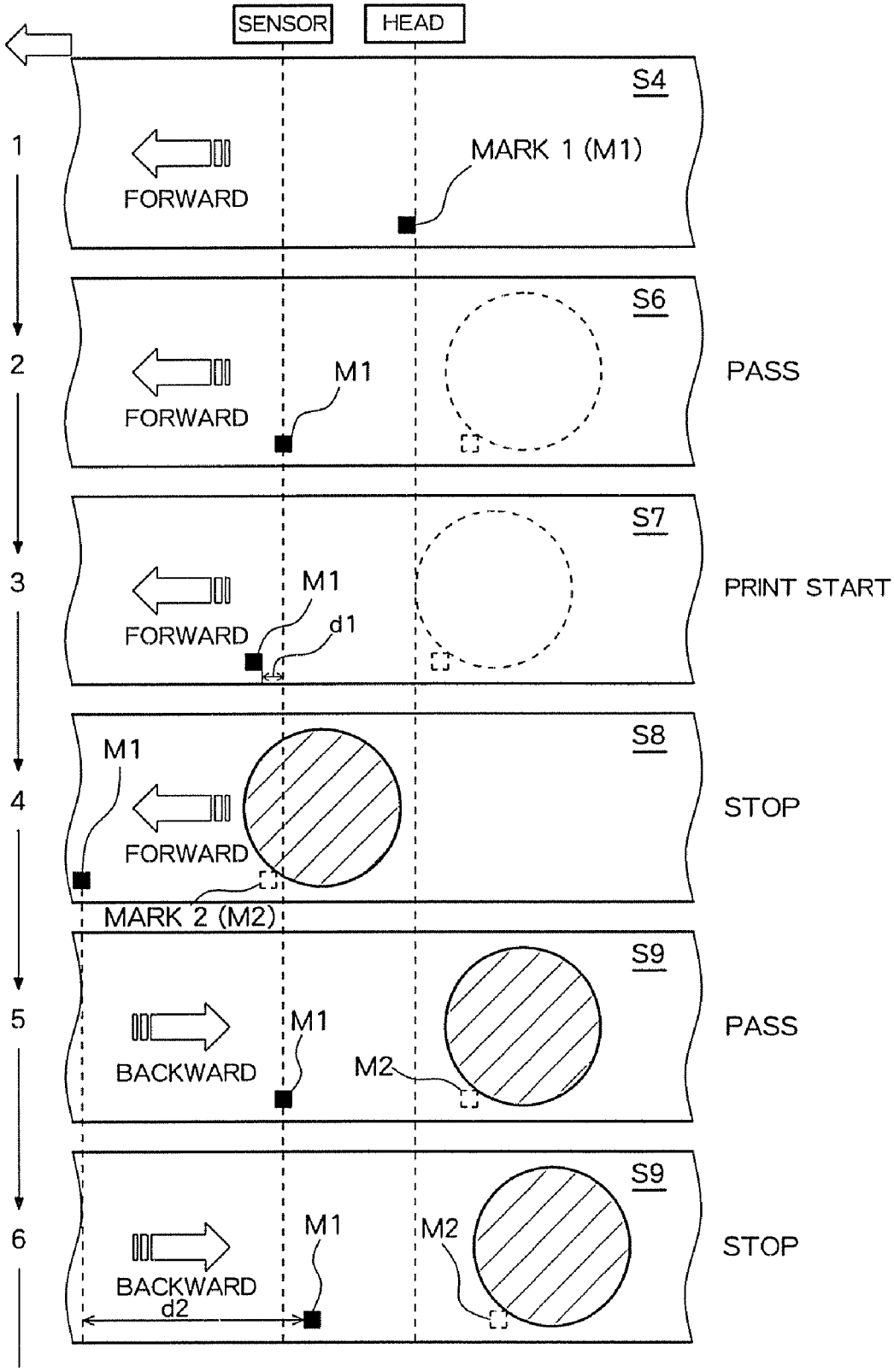
FIG. 6A is a descriptive view (part 1) of print processing for the intermediate transfer sheet.
Figure 6B:
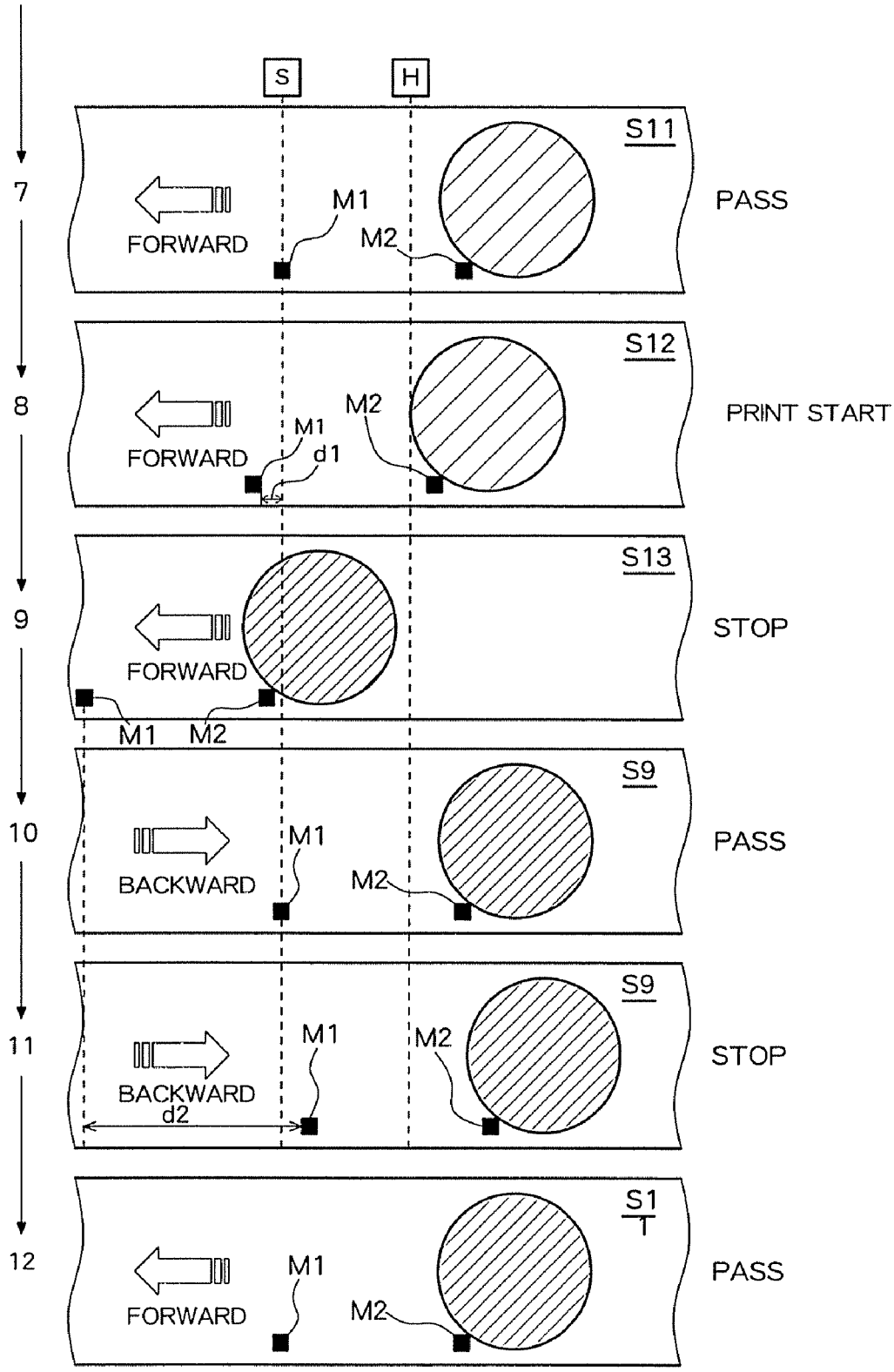
FIG. 6B is a descriptive view (part 2) of print processing for the intermediate transfer sheet.
Figure 6C:
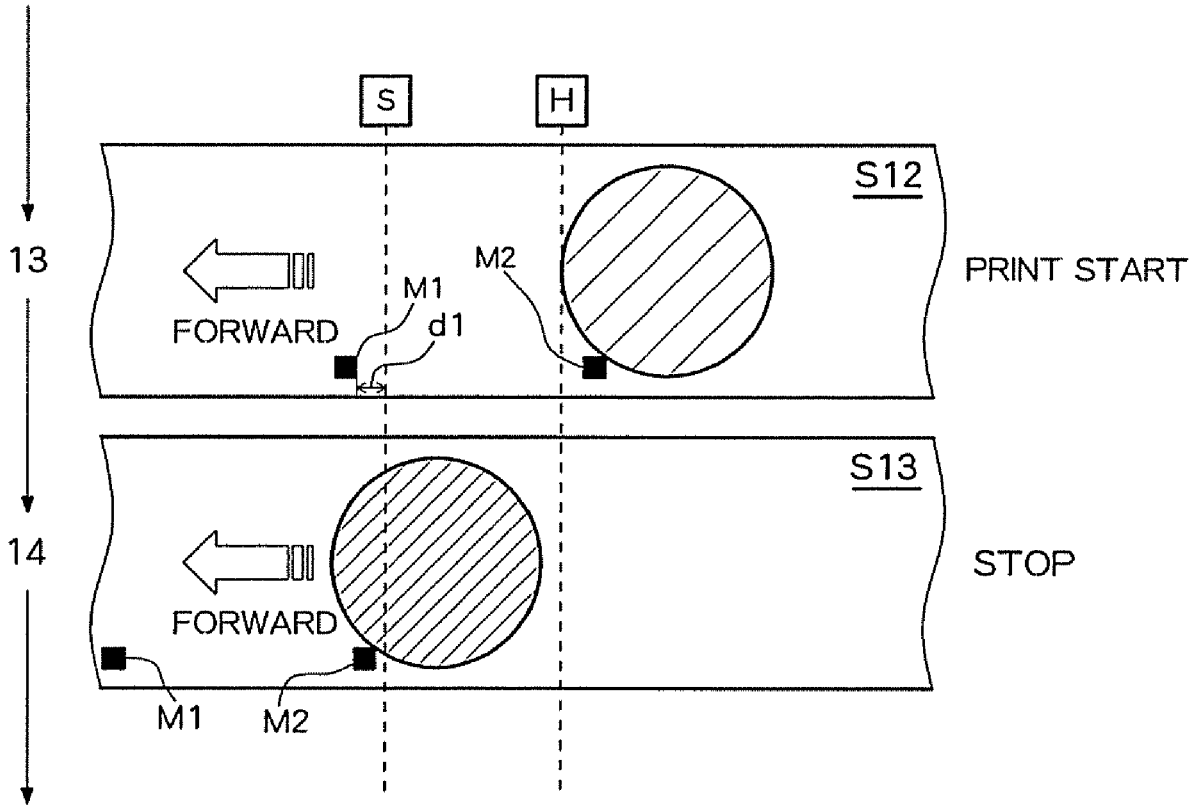
FIG. 6C is a descriptive view (part 3) of print processing for the intermediate transfer sheet.

FIG. 5 shows a processing flowchart of the present embodiment. FIGS. 6A, 6B, and 6C show a plan view of the intermediate transfer sheet 5 achieved in respective steps.

First, the intermediate transfer sheet 5 is taken up by a predetermined distance (S1). It is detected whether or not the position marks 5BK pass by the sensor (S2). When the position marks 5BK are not yet produced, the position marks 5BK are not detected (NO in S2). Therefore, the intermediate transfer sheet 5 is conveyed forwardly (S3), and the position marks 5BK are produced by use of the black ink area 102 of single color C of ink (S3). In the following descriptions, the position marks 5BK are referred to simply as position marks M1, M2, M3, . . . . FIG. 6A-1 shows a situation where a position mark 5BK(M1) is produced on the intermediate transfer sheet 5 by means of the thermal print head 8 (indicated as "HEAD" in the drawing).

After generation of the position mark 5BK(M1), the intermediate transfer sheet 5 is fed forwardly (S5), thereby detecting the position mark M1 by means of the sensor (S6). When the position mark M1 cannot be detected despite formation of the position mark M1, an error is determined to have arisen. When the position mark M1 is detected (YES in S6), the intermediate transfer sheet 5 is further fed forwardly by a predetermined amount d1 (S7). FIG. 6A-2 shows a situation where the position mark M1 is detected by means of the sensor, and FIG. 6A-3 shows a situation where the intermediate transfer sheet 5 is further fed forwardly by a predetermined amount d1 when the position mark M1 is detected. The sensor is the mark detection means 23A.

After the intermediate transfer sheet 5 is fed forwardly by the predetermined amount d1, the single color image CI is printed in single color C of ink on the intermediate transfer sheet 5. Further, a position mark M2 is generated by use of black ink for printing a mark; namely, the black ink area 102 formed along the edge of the area of the single color C of ink (S8). FIG. 6A-4 shows a situation where the position mark M2 is formed along with the single color image CI. After formation of the single color image CI and the position mark M2, the intermediate transfer sheet 5 is taken up by a predetermined distance d2 (S9). FIGS. 6A-5 and 6A-6 show a situation where the intermediate transfer sheet is taken up by the predetermined distance d2.

After being taken up by the predetermined distance d2, the intermediate transfer sheet 5 is again fed forwardly (S10), and the position mark M1 is detected by means of the sensor (S11). Since the predetermined distance d2 is set in such a way that the position mark M1 exceeds the position of the sensor, the position mark M1 is detected by means of forwardly feed the intermediate transfer sheet 5 under normal operating conditions. When the position mark cannot be detected, an error is determined to have arisen. When the position mark M1 is detected, the intermediate transfer sheet 5 is forwardly fed by the predetermined amount d1 (S12). FIGS. 6B-7 and 6B-8 show situations where the position mark M1 is detected and where the intermediate transfer sheet is forwardly fed by the predetermined amount d1.

Figure 9:
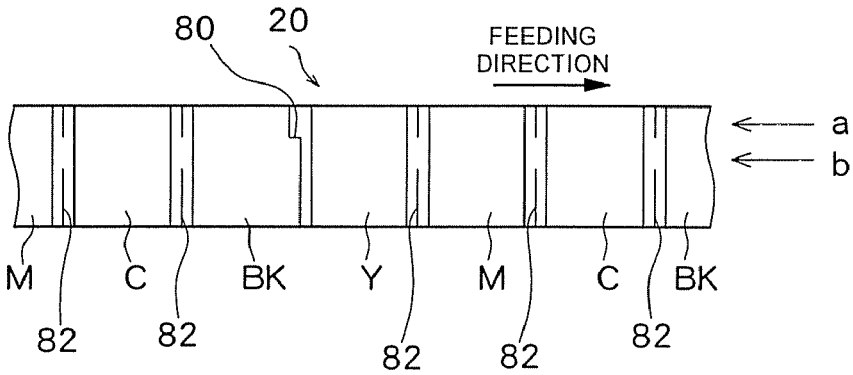
RELATED ART FIG. 9
FIG. 9 is a plan view of the related-art ink sheet.

After forward feeding of the intermediate transfer sheet by the predetermined amount d1, the single color image MI is printed in single color M of ink on the single color image CI of the intermediate transfer sheet 5 (S13). FIG. 6B9 shows a situation where the single color image MI is produced in a single color M of ink. A determination is made as to whether or not printing is completed in all of the three colors of ink (S15). In the present embodiment, printing of single color Y of ink is not yet completed, and hence processing returns to S9, where processing is iterated. Specifically, the intermediate transfer sheet 5 is taken up over a predetermined distance d2, to thus detect the position mark M1. Then, the intermediate transfer sheet is forwardly fed by the predetermined amount d1, and a single color image YI is printed in the single color Y of ink on the single color images CI and MI. FIGS. 6B-10 and 6B-11 show situations where the intermediate transfer sheet is returned by the predetermined amount d2. FIG. 6B-12 shows a situation where the position mark M1 is detected; FIG. 6C-13 shows a situation where the intermediate transfer sheet is forwardly fed by the predetermined amount d1; and FIG. 6C-14 shows a situation where the single color image YI is produced in single color Y of ink. After printing of all colors of ink ends, the full color transfer image FCI is covered with the adhesive layer T, and processing is completed. A next transfer image is performed likewise with reference to the position mark M2.

Figure 7:
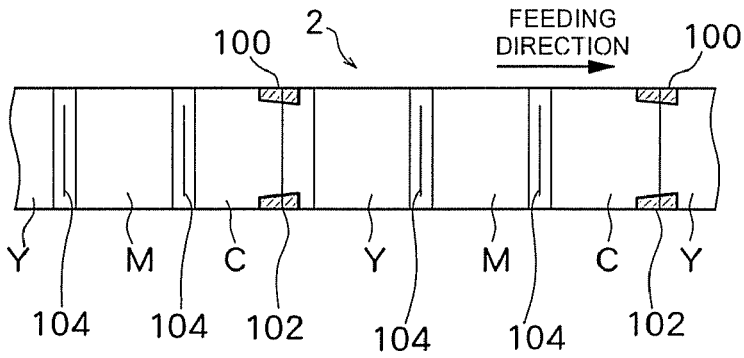
FIG. 7 is another plan view of the ink sheet.

In the present embodiment, in addition to the single colors C, M, Y of ink, the adhesive layer T is used as shown in FIG. 2. However, the adhesive layer T is not always necessary. FIG. 7 shows the structure of the ink sheet 2 that does not use the adhesive layer T. Only the single colors C, M, and Y of ink are present. The black ink areas 100 and 102 are located along the edges of the area of the single color C of ink, and the black ink lines 104 are arranged along boundaries among the single colors of ink.

What is claimed is:

1. A printer that transfers to one image formation area a plurality of single colors of ink repeatedly arranged in a longitudinal direction of the ink sheet, to thus produce in an image formation area of an intermediate transfer sheet a transfer image formed as a result of lamination of single color images and that transfers the transfer image of the intermediate transfer sheet to a subject to be printed, thereby producing a desired image on the subject, the printer comprising:

an ink sheet feeding section for feeding the ink sheet;

an intermediate transfer sheet feeding section for feeding the intermediate transfer sheet;

a printer head that is disposed so as to face a feeding path of the ink sheet and a feeding path of the intermediate transfer sheet and that transfers ink of the ink sheet to the intermediate transfer sheet; and a print head control section that transfers a position mark to a location outside the image formation area of the intermediate transfer sheet by use of a black ink area provided at a specific position of an area of another first single color of ink of the ink sheet during a course of a single color image being produced in the first single color on the intermediate transfer sheet by means of transferrin the first single color of ink from the ink sheet to the image formation area of the intermediate transfer sheet.

2. The printer according to claim 1, wherein the specific position is an edge of the area of the first single color of ink in a widthwise direction thereof.

3. The printer according to claim 2, wherein the black ink area is formed in numbers so as to become symmetrical with respect to a center axis of the ink sheet in a longitudinal direction thereof.

4. The printer according to claim 3, further comprising:

black ink line areas provided at boundaries among the plurality of single colors of ink of the ink sheet and along a widthwise direction of the ink sheet so as to become symmetrical with respect to the enter axis.

5. The printer according to claim 1, wherein the plurality of single colors of ink of the ink sheet are arranged in sequence of cyan, magenta, and yellow, and the black ink area is disposed in an area of cyan.

6. An ink sheet used with a printer that transfers to one image formation area a plurality of single colors of ink repeatedly arranged in a longitudinal direction of the ink sheet, to thus produce in an image formation area of an intermediate transfer sheet a transfer image formed as a result of lamination of single color images and that transfers the transfer image of the intermediate transfer sheet to a subject to be printed, thereby producing a desired image on the subject, the ink sheet comprising:

a black ink area arranged at a specific location of an area of another first single color of ink of the plurality of single colors of ink.

7. The ink sheet according to claim 6, wherein the specific position is an edge of the area of the first single color of ink in a widthwise direction thereof.

8. The ink sheet according to claim 7, wherein the black ink area is formed in numbers so as to become symmetrical with respect to a center axis of the ink sheet in a longitudinal direction thereof.

9. The ink sheet according to claim 7, wherein the black ink area is made up of a position mark formation area disposed at one edge in the widthwise direction and another area disposed at another edge in the widthwise direction so as to become symmetrical about the position mark formation area with respect to the longitudinal center axis.

10. The ink sheet according to claim 6, further comprising:

black ink line areas provided at boundaries among the plurality of single colors of ink of the ink sheet and along a widthwise direction of the ink sheet so as to become symmetrical with respect to the center axis.

11. The ink sheet according to claim 6, wherein the plurality of single colors of ink of the ink sheet are arranged in sequence of cyan, magenta, and yellow, and the black ink area is disposed in an area of cyan.

* * * * *